US005129642A

United States Patent [19]

Svyatsky et al.

[11] Patent Number: 5,129,642

[45] Date of Patent: Jul. 14, 1992

[54] CONTROLLABLE DOCUMENT DRIVE AND SEPARATION SYSTEM

[75] Inventors: Eduard Svyatsky, Chicago; Thomas J. Faber, Skokie, both of Ill.

[73] Assignee: Bell & Howell Company, Skokie, Ill.

[21] Appl. No.: 654,278

[22] Filed: Mar. 4, 1991

Related U.S. Application Data

[63] Continuation of Ser. No. 202,099, Jun. 2, 1988, abandoned.

[51] Int. Cl.[5] ..... B65H 5/00

[52] U.S. Cl. ..... 271/10; 271/116; 271/118; 271/122; 271/265; 271/124

[58] Field of Search ..... 271/10, 116, 117, 118, 271/121, 122, 124, 125, 265, 104, 137

[56] References Cited

U.S. PATENT DOCUMENTS

| | | | |
|---|---|---|---|
| 3,754,754 | 8/1973 | Peterson | 271/125 X |
| 4,061,329 | 12/1977 | Sachuk et al. | 271/118 X |
| 4,203,586 | 5/1980 | Hoyer | 271/125 X |
| 4,368,881 | 1/1983 | Landa | 271/125 X |
| 4,420,151 | 12/1983 | Kobayashi | 271/263 |
| 4,522,385 | 6/1985 | Stefansson | 271/122 X |
| 4,674,736 | 6/1987 | Tsubo | 271/122 |
| 4,709,911 | 12/1987 | Saiki et al. | 271/116 X |
| 4,753,433 | 6/1988 | Rodi et al. | 271/265 X |
| 4,822,023 | 4/1989 | Miyoshi | 271/118 |

FOREIGN PATENT DOCUMENTS

| | | | |
|---|---|---|---|
| 61242 | 5/1981 | Japan | 271/116 |
| 829719 | 3/1960 | United Kingdom | 271/121 |

*Primary Examiner*—David H. Bollinger

[57] ABSTRACT

In a combination document feed system and intelligent document separation system, including a document removal assembly associated with the document feed system for removing documents one at a time from a stack of documents disposed in the document feed system and feeding each document into the document transport system: comprising a document removal assembly for providing a contact surface between the document removal assembly and a lead document in the stack of documents, the contact surface adapted to alternately contact the lead document and advance the lead document from the document feed system to the document separation system. A document advancing apparatus is adapted to advance a single document properly removed from the stack of documents, to halt the movement of one of two documents improperly removed from the stack of documents, and to reverse the direction of movement of additional documents improperly removed from the stack of documents. A sensor associated with the document separation system senses the document feed condition of a feed roller assembly forming part of the intelligent document separation system, and generates a signal responsive to document feed condition.

27 Claims, 7 Drawing Sheets

CONTROLLABLE DOCUMENT DRIVE AND SEPARATION SYSTEM

This is a continuation of application Ser. No. 07/202,099, filed Jun. 2, 1988, now abandoned.

The present invention relates generally to a document drive and separation system, and in particular to a document separation mechanism for efficiently advancing documents, one at a time, from a horizontally disposed edgewise supported stack at a feeder station to a document separation station where multiple documents improperly fed are systematically rejected and only one document is permitted to advance to a document transport station.

BACKGROUND OF THE INVENTION

The conduct of business today requires the generating, handling, and processing of vast quantities of documents. The information on many of these documents must be read and understood, and then processed for further action depending upon the information on the document. By way of example, a check may have to be read and processed further to properly debit the account of the payor. Or, the address on a mailing envelope, including a zip code, may have to be read before the envelope is forwarded to its proper bin for distribution. Various automatic reading apparatus have been developed, including bar code reading equipment, magnetic-ink character reading devices, optical scanners, and the like, to increase the speed at which documents are processed. As the newly developed procedures related to reading and handling of documents have decreased the time necessary to interpret documents, the speed at which such documents can be passed through document handling apparatus has increased. Document handling apparatus has been developed to automatically and rapidly transmit documents, one at a time, from a feeding station, through a transport station, and to a further processing station, for example, the latter comprising a document indicia reading station.

Some presently available document handling apparatus of the type referred to herein utilize document feed systems which may include intermittently driven roller devices at the end of a spring loaded horizontally disposed edgewise stack of documents, for example, to feed documents, preferably one at a time, from the end of the stack to a transport station having a separating mechanism which sequentially delivers individual documents to the next work or processing station. Since many of the documents in the stack, such as checks, envelopes, or the like, may be of different sizes or paper quality, and have different effective coefficients of friction between adjacent pairs of documents, it is often difficult to ensure the feeding and advancement of one document at a time from the stack.

After a document has been typically advanced laterally from the end of a stack of documents, it is advanced between a pair, or possibly multiple pairs, of nip rollers, which nip rollers are disposed downstream in the direction of feed once the document has been removed from the stack. Certain nip roller assemblies currently in use provide two functions. First, some nip roller assemblies merely advance the document forward to its next work station, while in some other instances they accelerate the speed of document travel compared to the speed of original removal from the stack of documents at the feed station. Second, certain nip rollers have been designed to perform a separation function by preventing the feed of more than one document at a time from the stack. For example, in addition to forwardly driven nip rollers to engage and advance a properly fed single document, an additional reverse driven roller may be provided to engage one side of a group of multiple documents improperly passing through the nip rollers for the purpose of driving none but the sequentially first or end-most document from the stack to the next station. The other, improperly fed, multiple documents contacted by the reversely driven roller are driven backwards, or their forward motion is halted, depending upon the friction generated between the documents.

Presently available document separation mechanisms of the type described do not provide intelligent means at the nip of the document advancing rollers to sense the condition of the feeding process, namely whether one or multiple documents are being fed through the document separation system, and to control further action of the document feed system responsive to conditions at the point of juncture of the nip rollers. Multiple document feed sensing systems presently in use normally detect a multiple feed condition downstream of the nip rollers, where it may be too late to initiate a control signal to activate the appropriate corrective servo motors or other control elements in time to prevent multiple documents from advancing through the entire system.

Therefore, a primary object of the present invention is to provide a document feed and separation mechanism which efficiently feeds documents one at a time from an initial stack of documents and advances individual documents to a further work or processing station, without any of the shortcomings of currently available devices noted above.

Yet another object of the present invention is to provide a document advancing roller assembly for an intelligent document separation system which prevents the advancement of more than one document at a time to a transport station, using a single roller element forming part of a nip roller assembly which automatically rotates in a forward mode, in a reverse mode, or is stopped depending upon certain conditions of the document feeding operation.

An additional object of a first embodiment of the present invention is to provide a nip roller assembly for engaging and advancing a moving document after the document has been removed from a stack of documents, which nip roller assembly includes a selectively rotatable drive roller unit and a back-up roller unit, the latter being selectively driven by a single rotating shaft, such that the nip roller assembly is capable of driving a single document forward; of reversing the movement of all but one document when a plurality of documents are inadvertently fed into the nip roller assembly; of advancing documents one at a time when a plurality of documents are inadvertently lodged up against the back-up roller, but not fed into the nip between the drive roller unit and the back-up roller unit; and of initiating a document feed sequence when there are no documents between the drive roller unit and the back-up roller unit.

An object of another embodiment of the present invention is to provide a nip roller assembly for engaging and advancing a moving document after the document has been removed from a stack of documents, which nip roller assembly includes one roller which is selectively driven by a single rotating shaft and is capable of driving a single document forward, or, of halting the forward progress of the second of two advancing documents, and/or of reversing the forward progress of any additional documents which may have been inadvertently removed from the stack.

Still another object of the present invention is to provide a unique document separation system including a drive shaft assembly for a drive roller which selectively drives or halts the drive roller automatically in response to the presence or absence of a single or multiple documents disposed between the drive roller and an adjacent back-up roller.

A further object of the present invention is to provide a nip roller assembly for engaging a moving document after the document has been removed from a stack of documents, which nip roller assembly includes a back-up roller drive shaft constantly driven in a single direction, and a back-up roller element capable of being operatively connected to said constantly rotating drive shaft whereby the nip roller assembly's back-up roller element can rotate in either a forward or reverse direction, or be stopped, relative to movement of a document advancing from a feed station, depending upon the number of documents being fed simultaneously from the feed station to the nip roller assembly.

Another object of the present invention is to provide a sensing device responsive to document feed conditions at the point where the document separation system of the present invention initially engages (1) a document properly fed, or (2) multiple documents improperly fed, from a document feeding station. A further object is to transmit the signal created in the sensing device to a controller unit to control further operation of the document feed and document separation systems depending upon whether documents have been properly or improperly advanced from the stack of documents.

SUMMARY OF THE INVENTION

These and other objects of the present invention are accomplished by a combination document feed system and an intelligent document separation system, including a document removal assembly associated with the document feed system which removes documents one at a time from a horizontally arrayed edgewise stack of documents and serially feeds the removed documents into the intelligent document separation system. The improved document removal assembly includes document contact means such as a constantly rotating infeed roller which is selectively pivoted to initially contact and advance the lead document in the stack. The preferred embodiment of the intelligent document separation system of the present invention provides an advancing means including a nip roller separation assembly including at least one drive roller and a like number of backup rollers which are uniquely adapted to advance a single document properly removed from the stack of documents; to reverse the direction of movement of the backup roller when more than one document is improperly removed from the stack; and, to sequentially advance a plurality of documents improperly removed from the stack and disposed in abutment with the back-up roller, but not between the nip of the drive roller and the back-up roller. The intelligent nip roller assembly of the present invention also detects the absence of documents in the separation system, which initiates a signal to commence operation of the document feed system at the stack. Sensing devices associated with the previously described nip roller assembly sense the feed condition of the document separation system at the point where a single document properly, or a plurality of documents improperly, initially enters the separation system, and creates a signal based on the direction of rotation of the drive and the backup rollers which can be transmitted to a document feed controller which, for example, can inhibit the further feed of documents until a detected malfunction at the nip roller assembly location is cleared.

In another embodiment of the present invention, the intelligent document separation system provides a single nip roller assembly which advances a single document properly removed from the stack of documents; to halt the direction of movement of one of two documents improperly removed from the stack; and to reverse the direction of movement of additional documents improperly removed from the stack.

DESCRIPTION OF THE PREFERRED EMBODIMENT

Figure 1:
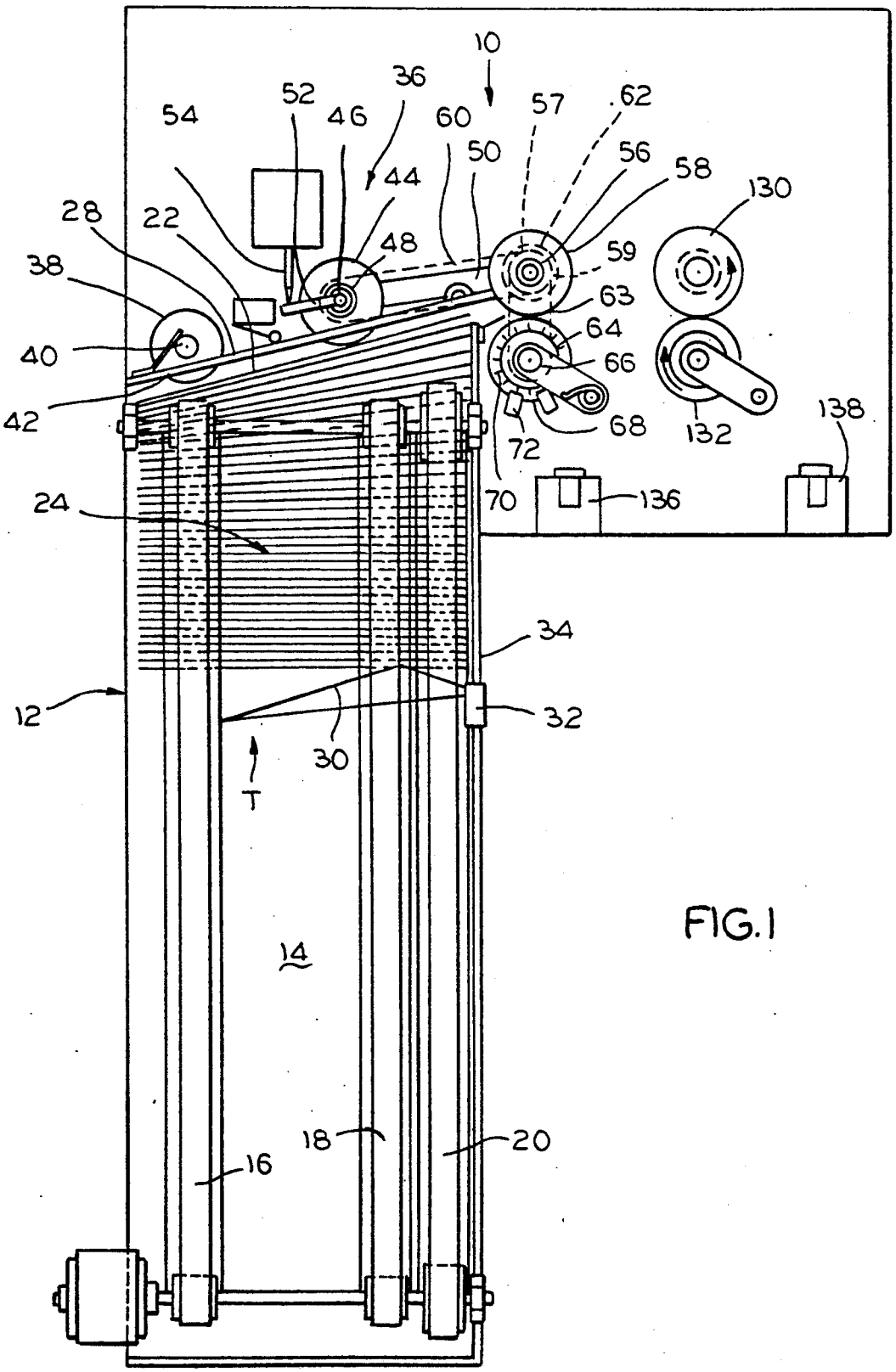
FIG. 1 is a schematic plan view of one embodiment of the document infeed drive and separation mechanism of the present invention, shown in association with a document feed tray from which documents are removed and separated, if necessary, one at a time by the presently disclosed invention.

Referring now to the drawing wherein similar numerals are utilized to designate similar parts, and particularly to FIG. 1, the document feed system in which the embodiments of the present invention form a part is generally designated by the numeral 10, and includes a feed tray 12 having a bottom plate 14 along which a plurality of powered belts 16, 18, and 20 extend, each belt moving in the direction shown by the arrow "T". Documents 24 such as envelopes, checks, or the like, are arranged in a horizontally extending edgewise stack generally designated by the numeral 26. Each document stands vertically in tray 12 with its bottom edge resting on bottom plate 14 and belts 16, 18, and 20, and is urged toward a vertically disposed face plate 28 by a back plate 30 which is resiliently or otherwise driven forward as documents are sequentially removed from feed tray 12. The details of such a feed tray 12 are described in greater detail in applicant's copending application for U.S. patent application Ser. No. 07/109,714, filed Oct. 16, 1987, entitled FEEDER MODULE FOR USE IN A DOCUMENT FORWARDING SYSTEM, which is assigned to the common assignee of the present application.

As illustrated schematically in FIG. 1, back plate 30 is connected to a bracket 32 which slides along a rod-like member 34, and which moves forward under spring pressure, for example, to advance the documents 24 towards face plate 28. Back plate 30 advances along feed tray 12 at substantially the same speed as belts 16–20, thus providing a continuous and uniform feed of documents 24 to the forward end of feed tray 12 and face plate 28.

A document removal assembly generally designated by the numeral 36 is disposed at the forward end of document feed system 10 and feed tray 12. Document removal assembly 36 includes an idler roller 38 which rotates about an axis 40 and extends through a slot 42 in face plate 28 to engage the trailing edge of the lead document 22 in the stack 24. Idler roller 38 does not perform a feed function, but acts as a positioning roller to establish the limits of the forward travel of the left edge of each document 22, as viewed in FIG. 1, and to prevent each forward document 22 from frictionally engaging face plate 28 as the document is withdrawn laterally from the stack 24.

Document removal assembly 36 also includes a pair of coaxially spaced selectively powered infeed rollers 44 which are adapted to extend through a pair of slots in face plate 28, as viewed in FIG. 1. The slots extend to the right end of face plate 28. Rollers 44 rotate on a common shaft 46 that carries a motor 48, with the shaft 46 and motor 48, along with rollers 44, being mounted on the free swingable ends of a pair of spaced arms 50. One of the arms 50 carries an extension 52 that extends outwardly from the free end of the one arm 50 and which is acted upon by an axially moveable solenoid arm 54. It should be noted that the motor 48 is carried on but does not directly rotate shaft 46 (See FIG. 4). Motor 48 is constantly rotating and is rotatably connected to pulley 61, as best set forth hereinafter.

The swingable arms 50 are pivoted about the axis of shaft 56, which shaft also carries a pair of spaced drive rollers 58. Rollers 58 are powered by a timing belt 60 extending from pulley 61, that is rotatably connected to motor 48 to a first pulley 57 mounted on shaft 56, with an electromagnetic clutch means, generally designated by the numeral 62, being interposed between rollers 58 and powered pulley 57. A second pulley 59 mounted on shaft 56 is connected to a pulley 64 mounted on a second swingable shaft 66 supported by a swingable arm 67. The shaft 66 is split intermediate its length and interconnected by a flexible connector 65. Shaft 66 carries at its upper end a powered back-up roller 68 having a plurality of indicia means 70 mounted thereon and readable by at least one sensor 72, there being two sensors shown in FIG. 4, for purposes best set forth hereinafter. The flexible connector 65 permits the upper portion 166 of the shaft 66 to deflect along the arc 67*a* followed by arm 67 when a thick document passes through the nip formed by rollers 58 and 68.

Figure 4:
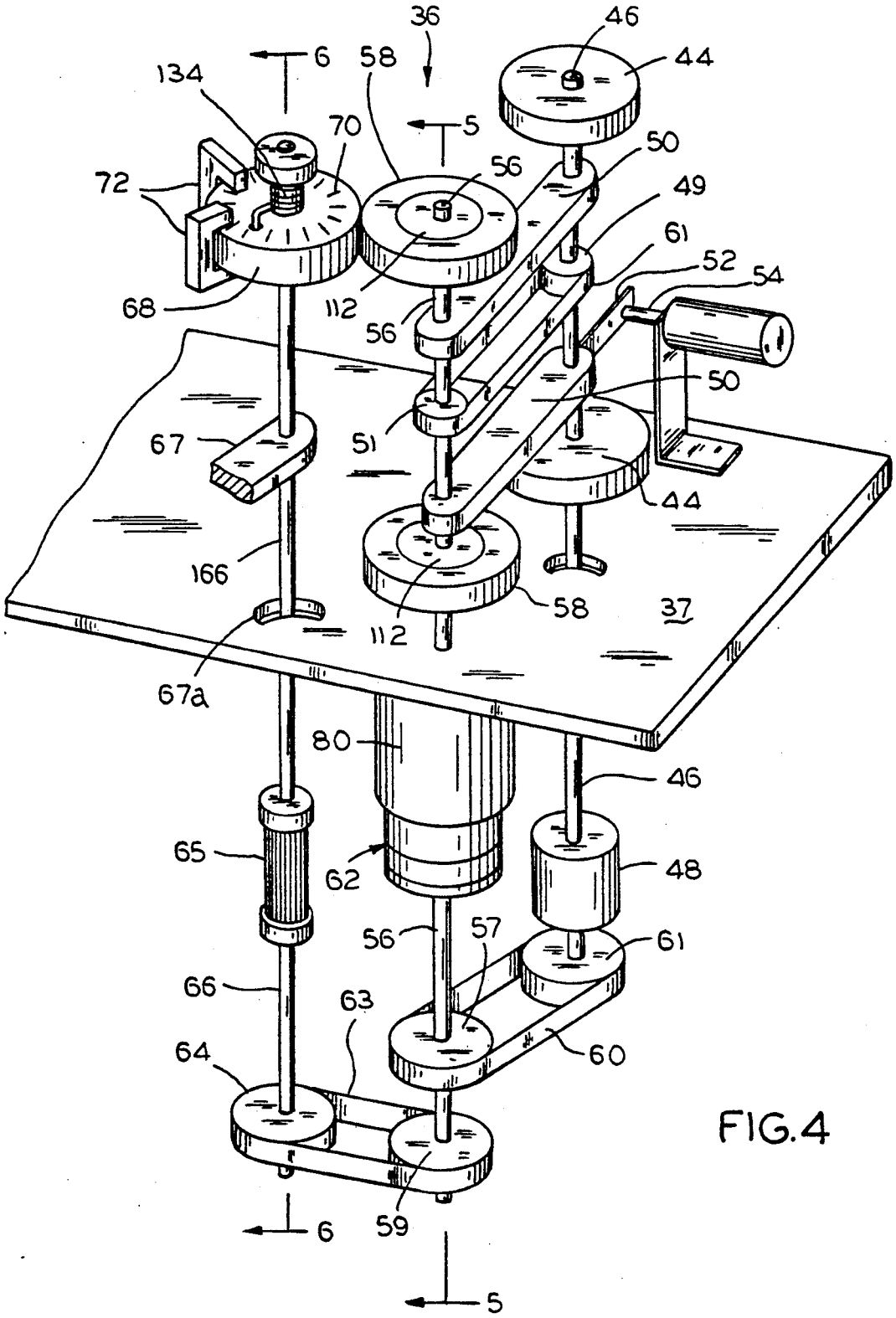
FIG. 4 is a perspective view in partial section from the backside of the document showing in generally expanded schematic form a preferred infeed, drive and separation system of the type shown in FIG. 1.
Figure 5:
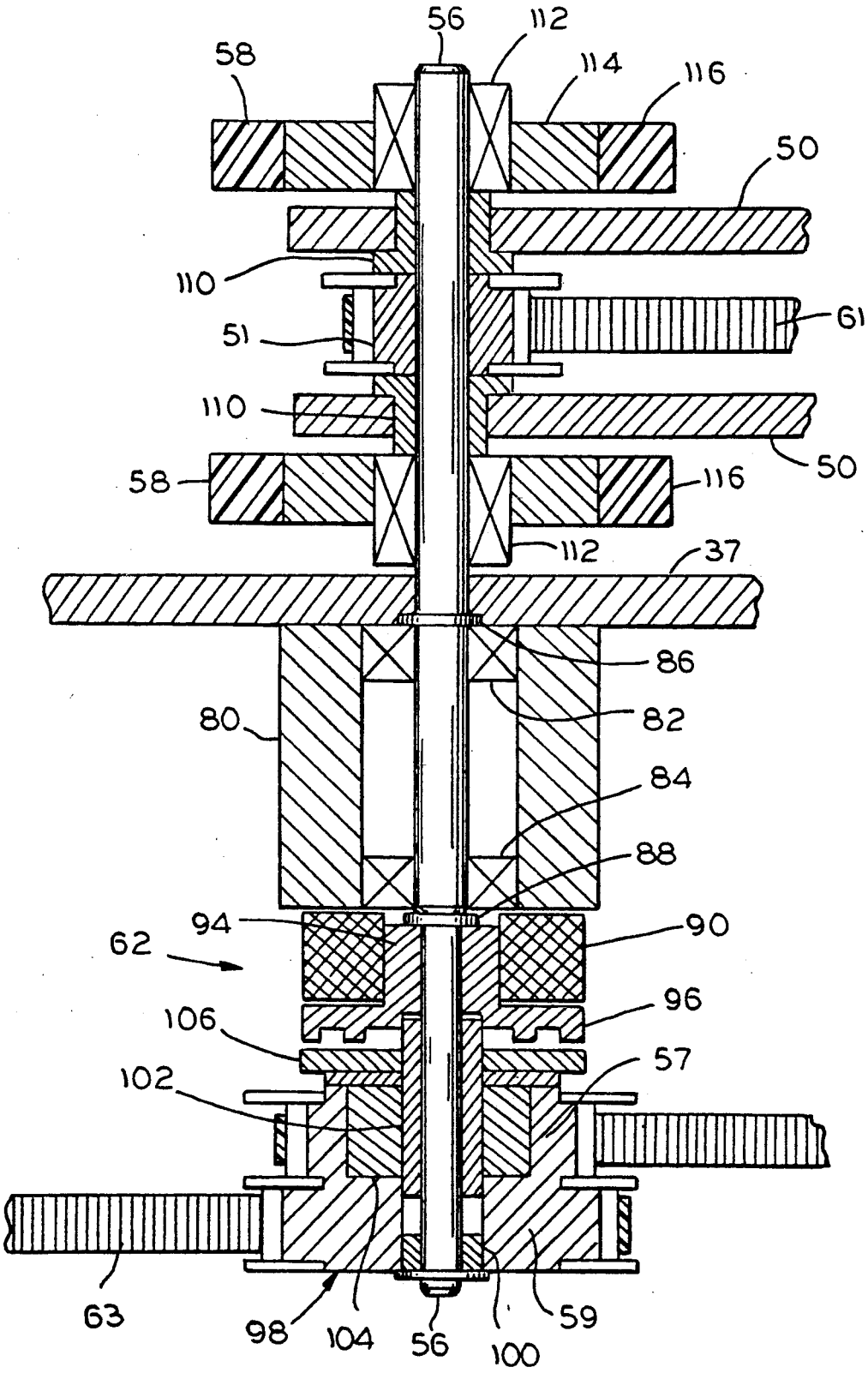
FIG. 5 is a vertical elevational view in partial section of a portion of the device shown in FIG. 4 as taken generally along line 5—5 of FIG. 4.

Referring now to FIGS. 4 and 5, an important feature of this invention is the controllable drive unit at the first feeding station which is generally designated by the numeral 36 and includes the drive rollers 58, the backup roller 68, the infeed rollers 44, and more particularly the electromagnetic clutch means generally designated 62.

The shaft 56 is axially supported by a hollow housing 80 fixed to the basic support plate means 37. Housing 80 includes a pair of axially spaced one-way or unidirectional clutch means 82 and 84 that engage complimentally spaced thrust washer means 86 and 88, respectively, mounted on shaft 56. The housing 80 also carries the electromagnetic clutch means, generally designated 62, and includes an electromagnetic coil 90 that is fixed against rotation relative to shaft 56. Fastened to shaft 56 and rotatable therewith is an electromagnetic clutch 62 that includes a hub 94 rotatable within coil 90 and an integral magnetizable plate means 96. At the lower end of shaft 56, as seen in FIG. 5, the pulleys 57 and 59 are preferably formed as an integral unit, designated 98, and supported in rotatable fashion on shaft 56 by a pair of spaced bearing means 100 and 102. Pulley unit 98 includes a pressed fit central metallic hub 104 carrying a clutch plate 106 fixed thereto, with the hub 104 and plate 106 being also connected to bearing 102. Thus, the pulley unit 98, with its hub 104, clutch plate 106 and bearing 102 being tied together, rotate freely about the shaft 56 when the electromagnetic coil 90 is deactivated. The upper hub 94 and plate 96 are connected to the shaft 56. When the coil 90 is activated by the application of current thereto, clutch plate 106 is coupled to plate 96 to drive shaft 56 by the input of power through timing belt 60 connected to the motor 48.

Mounted on the upper end of shaft 56 are the pair of spaced arms 50 which pivot about shaft 56 through the bearings 110. Supported between bearings 110 and fastened to shaft 56 is the pulley 51 that supplies power through timing belt 61 to the pulley 49 mounted on shaft 46 and provides rotation of rollers 44 for the infeed of documents from the stack 26. Mounted on shaft 56 outboard of the bearings 110 are the spaced rollers 58 that are supported by one-way clutch means 112. The rollers 58 include a rigid central hub 114 and a generally soft durometer outer plastic or rubber portion 116 for an improved coefficient of friction between the rollers 44 and rollers 58 as well as the documents 24 engaged thereby.

It should be noted that the arrangement of parts shown in FIG. 4 is schematic in nature and the individual components are axially expanded and spaced for clarity in illustration when compared to the engineering drawing type of disposition shown in FIG. 5.

The motor 48 is constantly running when the device is in a powered phase and when so running the power is constantly being supplied, to the backup roller 68 through the pulleys 57, 59, 61 and 64. Additionally, while shaft 56 is fixedly located relative to the support 37, the shafts 46 and the upper portion 166 of shaft 66 are laterally moveable to accommodate the movement of the stack 26 relative to the rollers 44 and the thickness of documents passing between the power roller 58 and the backup roller 68 respectively.

As was indicated above, the motor 48 runs constantly and provides constant power to the backup roller 68 through the timing belts 60 and 63. The backup roller 68 includes a one-way brake/clutch means 134 which normally provides roller 68 with a direction of rotation that is the same as that of drive roller 58, which provides an opposite direction of movement where they engage. However, the coefficient of friction between the two rollers, when engaged, overcomes the clutch means 134 and causes roller 68 to move in the same direction (but opposite rotation) during their engagement. When a single document, having an adequate coefficient of friction, is engaged in the nip between rollers 58 and 68 the same result will occur, namely, the clutch 134 will be overcome and the direction of rotation of roller 68 will be reversed. When two or more documents are inadvertently fed from the stack by feed rollers 44 and the coefficient of friction between the documents is less than the torque required to reverse rotation of roller 68 the reverse movement of roller 68 at the point of tangency causes the direction of movement of the out of sequence document to be reversed and returned to the stack. The backup roller 68 is then brought into contact with the proper sequence document that is engaged on its opposite surface by drive roller 58, the clutch 134 is overcome by the torque of roller 58, the direction of rotation of roller 68 is reversed and the document is advanced to a pair of high speed nip rollers 130 and 132 positioned downstream for further transport of the document within the device. A sensor means 136 is positioned at the exit end of the nip between rollers 58 and 68 that will register the presence or absence of a document in that position. Similarly, a second sensor 138 is positioned at the exit end of the nip between rollers 130 and 132 for a similar purpose, as will be described hereinafter. In this manner, the drive rollers 58 and backup roller 68 serve as a document separation station which receives documents from the document removal assembly 36 under the action of the infeed rollers 44.

Figure 2:
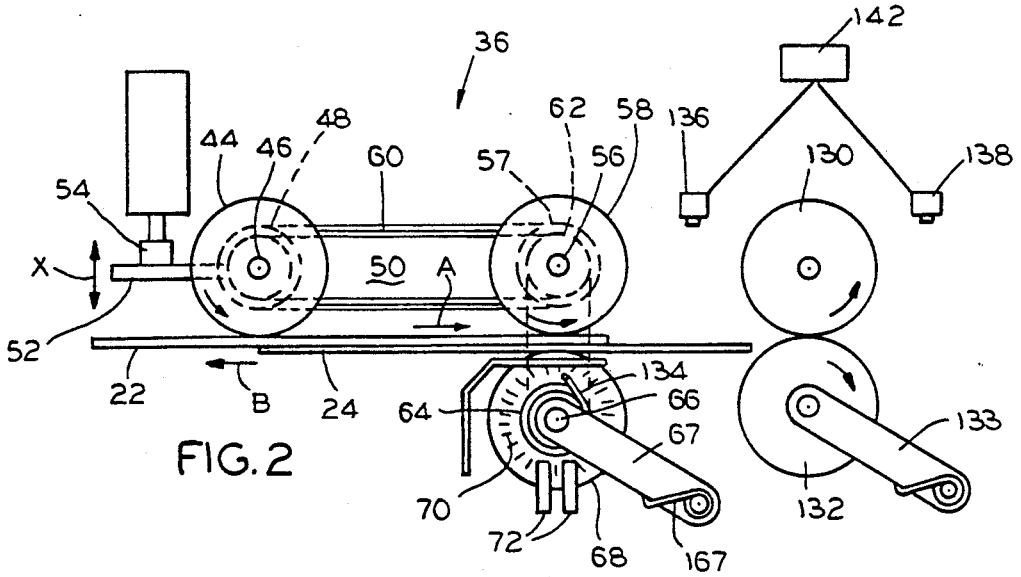
FIG. 2 is an enlarged detail of the schematic plan view, as generally shown in FIG. 1, of the document infeed and separation system of a preferred embodiment of the present invention adapted to receive one or more documents from the document removal system of the feed tray and to advance such documents serially one at a time to a further work station.

The frictional force (coefficient of friction) between paper to paper contact will vary and similarly the frictional force between paper and rubber or plastic rollers will vary. Therefore, there is a problem in controllability of separation of documents in a sequential fashion. This disparity often results in the problem of an overlap when one large and one short document are fed together. As can be seen in FIG. 2 the lead document 22 from the stack 26 has been inadvertently fed with a longer document 24 with the latter document blocking the sensor 136. The solution to the problem is to back up document 24 (in the direction of Arrow "B") all but the first document 22 and then resume feed (in the direction of Arrow "A"). In the case of drive roller 58, this roller requires a drive motion, a stop motion, means to prevent reverse rotation and has to be capable of releasing the document as it is grabbed in the nip of the high speed acceleration rollers 130, 132 downstream. These requisite functions for drive rollers 58 are accomplished by the engagement of the electromagnetic clutch 62 to transmit power from the constantly moving pulley 57, connected to motor 48, for powering rollers 58; the release of the electromagnetic clutch 62 to stop the rollers 58; and the one-way clutches 112 in rollers 58 as well as the one-way clutches 82, 84 engaging shaft 56 in the supporting housing 80, that prevent any backward motion of shaft 56.

Figure 3A:
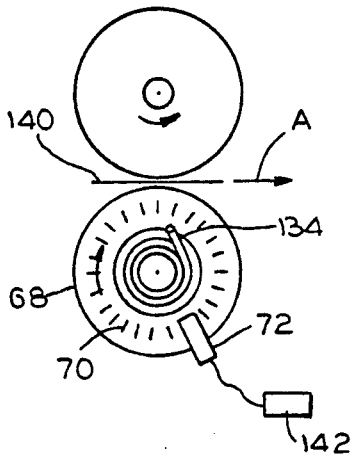
FIGS. 3A-3F are a plurality of schematic diagrams of the nip roller assembly used in the preferred document receiving and separation system showing the operation of the nip roller assembly that is generally shown centrally in FIG. 2, when one, two, and more than two documents are received from the document infeed drive assembly associated with the document feed tray shown in FIG. 1.

Referring to FIGS. 3A through 3F where various possible conditions of document drive, separation and delivery of multiple layers of documents are schematically illustrated, FIG. 3A discloses the situation where there are no documents being fed to the separation mechanism 36 and the drive roller 58 and backup roller 68 are in intimate contact at the point of tangency along the common tangent line 140. The coefficient of friction between the rollers overcomes the clutch 134 and backup roller 68 moves in the same direction (Arrow "A") as roller 58 along the line of tangency 140.

Figure 3B:
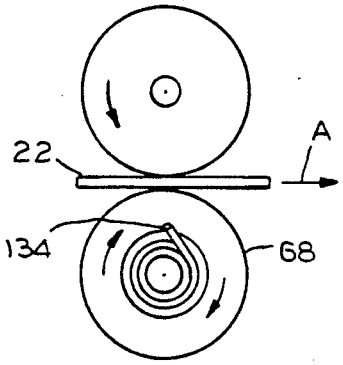

FIG. 3B shows a substantially identical situation where a single document 22 is between the rollers 58 and 68 and the coefficient of friction between the document 22 and the rollers 58, 68 is adequate to cause roller 68 to reverse direction and to follow the direction of roller 58 along the line of tangency and to move the document 22 (Arrow "A") towards the next station in the device, namely, the acceleration rollers 130, 132.

Figure 3C:
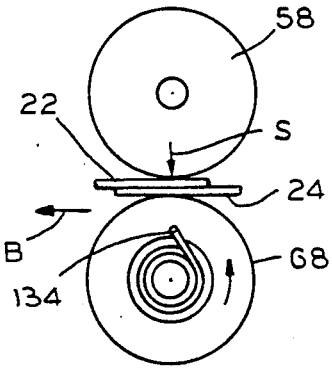
Figure 3D:
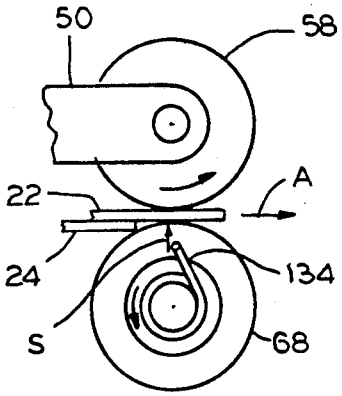
Figure 3E:
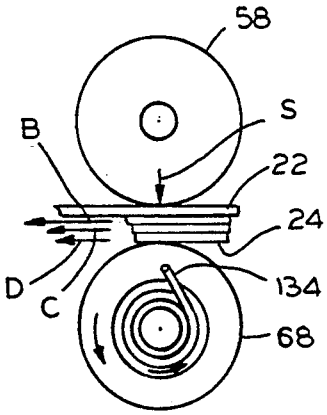

Referring now to FIGS. 3C and 3E, if more than one document is between the rollers and the sensor 136 is not activated the drive roller is stopped (Arrow "S"), while the backup roller 68 continues to rotate backwards, since the sensing device 72 reads the indicia 70 and recognizes the reverse rotation of backup roller 68 it sends out a signal which results in the disengagement of the electromagnetic clutch 62 and stops the drive roller 58, as well as the infeed roller 44 driven by the connecting belt 61. The one-way clutches 82, 84 and 112 prevent the drive rollers 58 from rotating backward. When all but one document have been fed backwards (Arrows "B", "C", and "D"), and only a single document 22 remains in the nip between the separation rollers, the backup roller 68 stops due to the high coefficient of friction between the roller 68 and the single document 22 resting against the stopped drive roller 58, this is accomplished by the friction of backup roller 68 impinging on the single document 22 and relating to the stopped condition of the document and roller 58 and thereby reacting against the clutch 134. This stoppage is sensed by sensor 72 and its readout means 142 which gives a signal to actuate the electromagnetic clutch 62 resulting in the drive roller 58 rotating forward. This gives the condition shown in FIG. 3B (Arrow "A"), a positive condition. At the same time the infeed roller 44 is actuated to in-feed the next document.

Figure 3F:
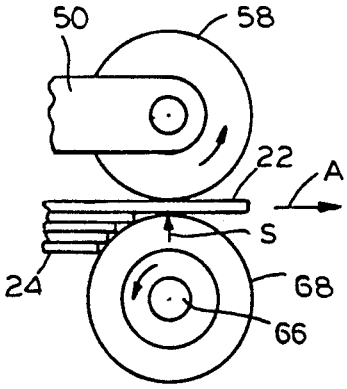

In the condition illustrated in FIG. 3F the drive roller 58 rotates forwardly, multiple documents are bucked up against the backup roller 68, but not between rollers 58 and 68. The pressure of the documents against roller 68 over-rides the clutch means 134 (not shown in this figure, for clarity in illustration) and stops the backup roller 68 from rotation (Arrow "S"). Therefore the sensors 72 recognize that the backup rollers 68 have stopped. The drive roller 58 keeps rotating with the clutch 62 still actuated, and the infeed rollers 44 are moved back away (Arrow "X"—FIG. 2) from stack 26 to stop infeeding of additional documents by retraction of the infeed solenoid arm 54. The multiple documents 24 shown in FIG. 3F will be fed sequentially (Arrow "A"), one at a time, through the nip by individual action of the drive roller 58.

FIG. 3D shows the situation of FIG. 3F when all but two of the documents have been fed through the nip.

A positive signal is also generated if there is no document in the nip between drive rollers 58 and backup roller 68 so that both rollers still are moving forward along the line of tangency 140, as seen in FIG. 3A. The infeed rollers 44 are activated to send in the next document with the electromagnetic clutch and infeed solenoid arm 54 in to actuated conditions. This activity takes place due to the sensing by sensor 136 of the absence of any documents passing within its field for a predetermined time parameter.

It should be recognized that the indicia markings 70 on backup roller 68 shown in FIG. 3A have been omitted from the other representations of backup roller 68 in FIGS. 3B through 3F merely for the purpose of clarity in illustration. Similarly, the at least one sensor 72 and its accompanying analyzing means 142 have been omitted for the same purpose. While there is only one sensor 72 illustrated in the FIG. 3 representations, it must be recognized that plural sensors 72 (shown in FIG. 2) can be utilized, as seen in the two sensors 72 shown in FIG. 2. Since FIG. 3 illustrations are schematic in nature to show the direction of operation of the drive and backup rollers the supporting arms 50 are only shown in two of the representations, but, as should be appreciated, form a part of the balance of the representations extending between and connecting the shaft 56 and the infeed roller shaft 46.

Thus, to summarize the operation of the preferred embodiment of the separation device 36:

1. At the startup of the machine and with no document in the nip of rollers 58 and 68;
   a. the backup roller 68 is stationary for a brief period of time;
   b. the drive roller is stationary;
   c. the stopped or inactive state of the indicia 70 is sensed by sensor 72 and transmitted to the receiving device 142 resulting in a signal to activate the electromagnetic clutch 62; d. the drive roller 58 immediately starts rotating and, being in engagement with the backup roller 68, causes the backup roller to override its spring clutch 134 and to also rotate forward in an opposite rotational direction to the drive roller;
   e. this gives a positive signal to sensor 72 even though there is no paper between rollers 58 and 68. However, the absence of a signal to sensor 138 causes the activation and extension of solenoid arm 54 causing the infeed roller 44 to feed the lead document 22 from the stack 26 to the nip between separation rollers 58 and 68 for delivery to the acceleration rollers 130 and 132 for transport to the next station in the device.
2. Where a single sheet is fed from the stack 26 by infeed roller 44 it is fed into the nip between rollers 58 and 68 and delivered forwardly (Arrow "A"—FIGS. 2 and 3B) into the grip of the nip between the acceleration rollers 130 and 132.
3. Where multiple documents are fed from 26 by infeed roller 44 but only one document is fed into the nip between the separation rollers and the remainder are bucked-up against the backup roller 68 (FIGS. 3D and 3F):
   a. the drive roller continues rotating in a forward direction;
   b. the backup roller is stationary with the torque thereof as well as the clutch 134 being overcome by the multiple documents bearing against the backup roller;
   c. the infeed rollers 44 are de-activated by being withdrawn by the solenoid arm 54 due to the sensing of non-rotation of the backup roller 68 by sensor 72; and
   d. the drive roller 58 continues to move the documents sequentially forward (Arrow "A") as they edge up the peripheral surface of stopped backup roller 68 to be engaged by the still rotating drive roller 58.
4. The last situation is where multiple documents get into the nip (FIGS. 3C and 3E). This can occur wherein there is such a high coefficient of friction between papers that they are not sufficiently lubricious to be readily separated and are pulled together by the infeed roller and those few multiple documents are advanced between the nip; also, an uncommonly large compression force on the stack of documents in the feed tray may cause a "package" of documents to be fed simultaneously; in these situations where a plurality of documents ends up in the nip:
   a. the drive roller 58 stops rotating (Arrow "S") by disengagement of the electromagnetic clutch 62;
   b. the infeed roller 44 is retracted (Arrow "X") by the solenoid arm 54 and the feeding of additional documents suspended, temporarily;
   c. the backup roller 68 continues rotating and returning documents to the stack 26 (Arrows "B", "C", and "D") until a single document 22 remains in the nip whence the backup roller will cease rotating because of the increased friction created by the single document between the rollers;
   d. the absence of movement of the backup roller sensed by sensor 72 results in the reactivation of the electromagnetic clutch 62 and the forward movement of the drive roller 58 causing the movement (Arrow "A"—FIG. 3B) of the single remaining document out of the nip of the separation rollers into the nip of the acceleration rollers 130 and 132.

Figure 6:
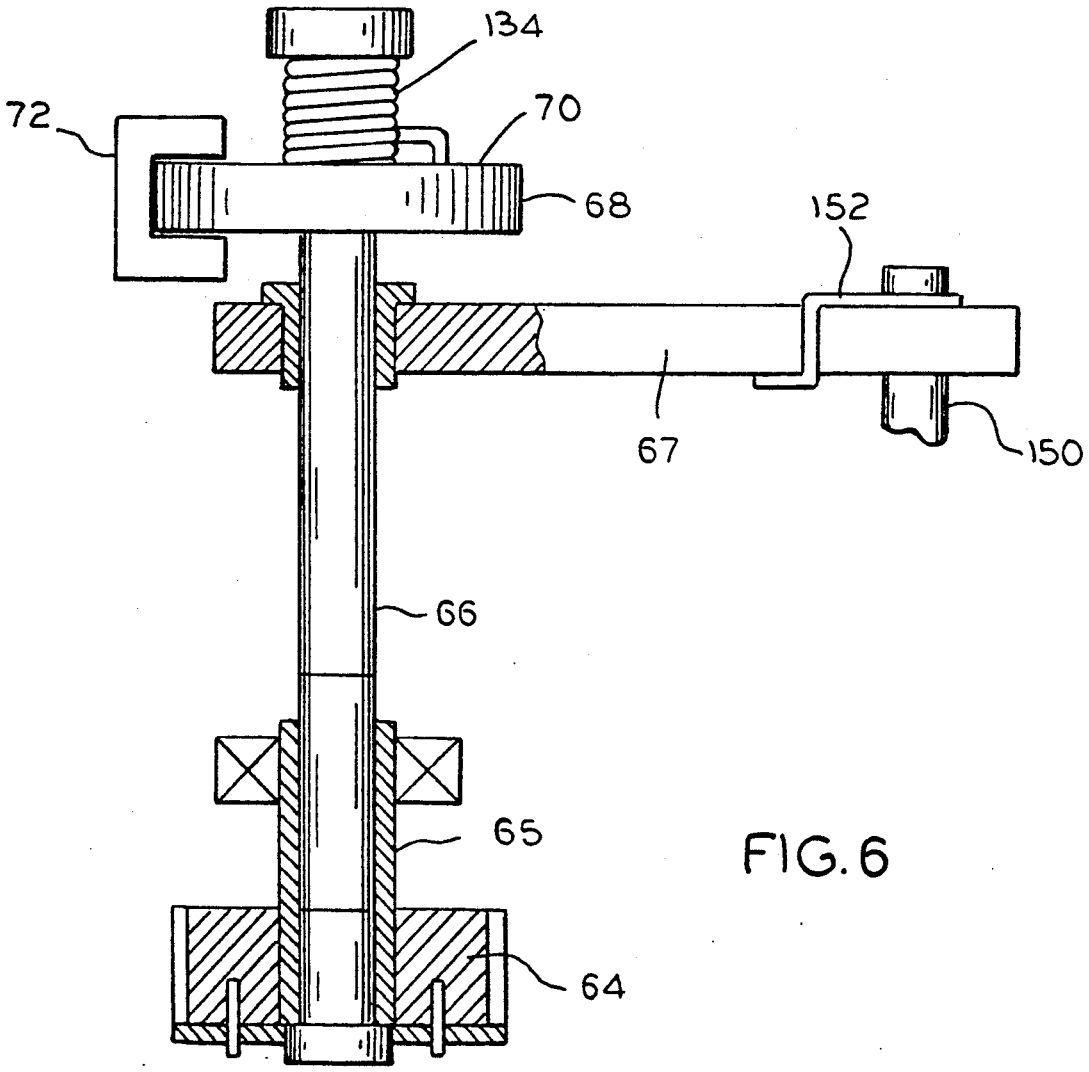
FIG. 6 is vertical elevational view in partial section of a portion of the device shown in FIG. 4 as taken generally along line 6—6 of FIG. 4.

It has also been found preferable to provide a flexible connector 65 between shaft 66 and the power transmission pulley 64, as shown in FIGS. 4 and 6. This permits a lateral movement of the upper portion 166 of shaft 66 to accomodate a spacing correction resulting from differing thicknesses of documents. The upper portion 166 of shaft 66 carries backup roller 68 and is supported by pivoted arm 67 that rotates about a post 150, with the arm 67 being spring urged into contact with the drive roller 58 by means of torque spring 152, thus arm 67 accomodates the spacing correction mentioned above.

Figure 7:
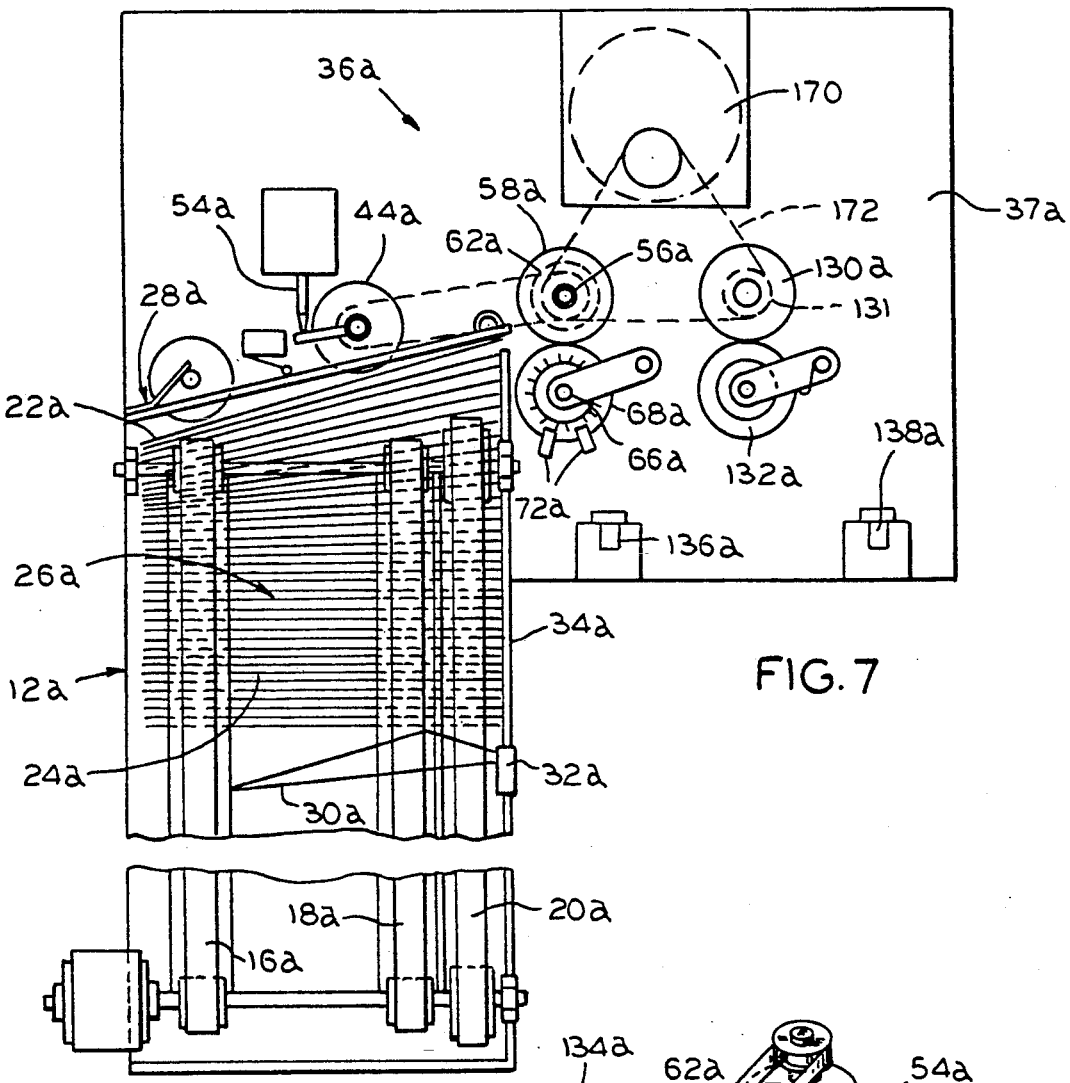
FIG. 7 is a schematic plan view of a second embodiment of the document infeed drive and separation mechanism of the present invention, shown in association with a document feed tray from which documents are removed and separated, if necessary, one at a time by the presently disclosed invention.
Figure 8:
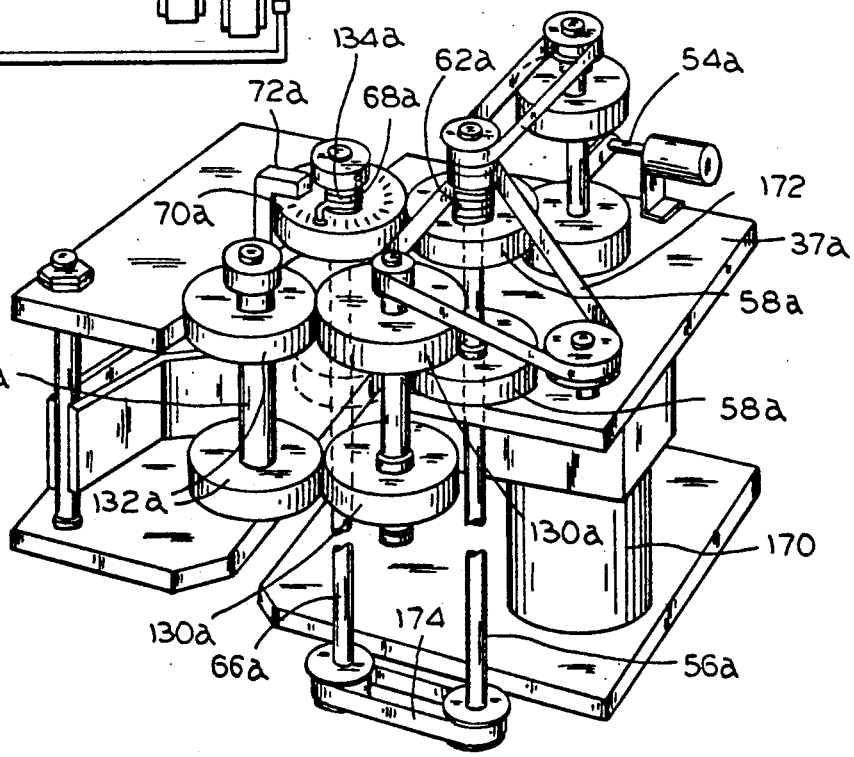
FIG. 8 is an enlarged detail of the schematic plan view, of the type shown in FIG. 7, of the document infeed and separation system of this second embodiment of the present invention adapted to receive one or more documents from the document removal system of the feed tray and to advance such documents serially one at a time to a further work station.

A second embodiment is schematically illustrated in plan view in FIG. 7 along with a partial perspective view from the backside thereof shown in FIG. 8. In this embodiment similar parts are identified by similar numerals with the addition of the suffix "a", wherein a feed tray **12*a* includes a plurality of longitudinally extending slots that accommodate moving belts 16*a*, 18*a* and 20*a* for accepting an edgewise stack of documents 26*a* which presents lead document 22*a* for engagement with a pivoted face plate 28*a*. A back plate 30*a* is connected to spring loaded bracket 32*a* and advances along feed tray 12*a* at the same rate of speed as the belts 16*a*, 18*a*, and 20*a*, to advance the stack 26*a* toward the face plate 28*a***.

The operation of the document separation assembly 36a includes similar parts and mode of operation of the preferred embodiment with the basic difference between the embodiments being that the motor 48 in the first embodiment was carried on shaft 46 whereas in this embodiment the motor 170 is independently mounted on the supporting structure 37a and power from the motor is transmitted by means of belt 172 that supplies power to not only the drive roller 58a but also to the acceleration roller 130a. The linear speed of roller 130a is greater than drive roller 58a by utilizing a smaller pulley 131 on roller 130a than the pulley supplying power to roller 58a which is being powered by the same timing belt 172. Hence the increased speed of rotation provides the acceleration required.

Power to the backup roller 68a is provided by a belt 174 interconnecting the drive roller 58a with said backup roller shaft 66a. Since backup roller 68a includes a spring clutch 134a its operation is substantially identical to the preferred embodiment. An electromagnetic clutch 62a is installed in the shaft 56a for controlling operation of the drive rollers 58a in a fashion similar to the first preferred embodiment. The sequence of operations of this second embodiment is substantially identical to the operations of the first preferred embodiment.

Figure 9:
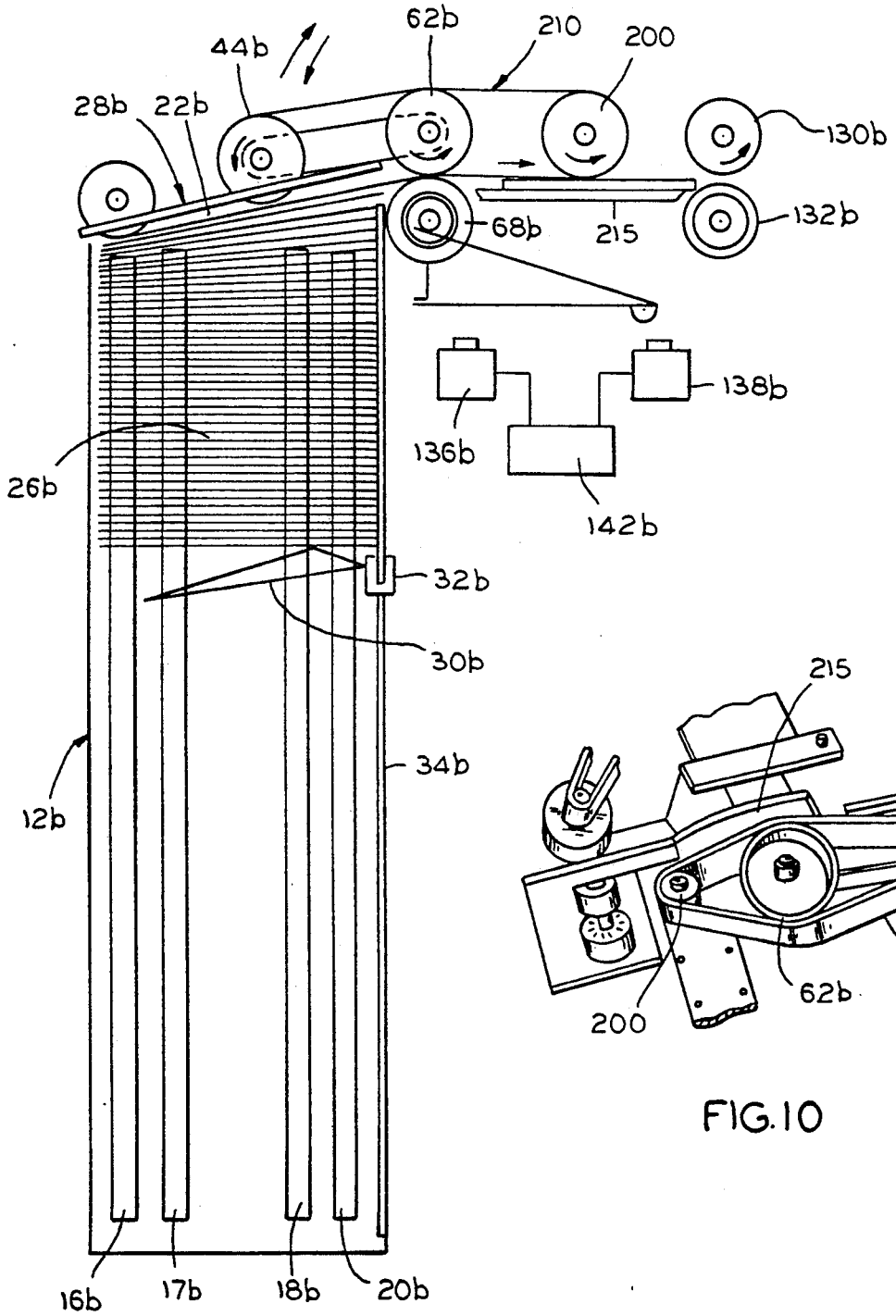
FIG. 9 is a schematic plan view of a further embodiment of the present invention.
Figure 10:
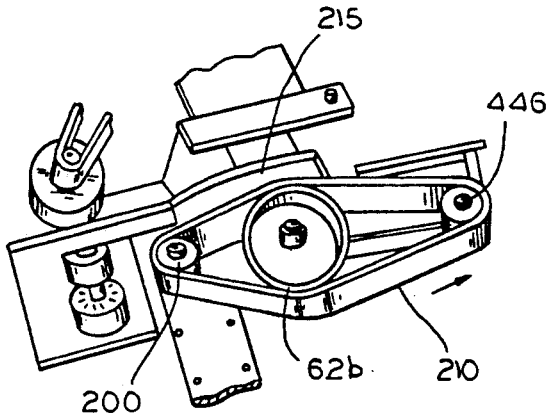
FIG. 10 is an inverted detail from the underside of the document infeed mechanism generally shown from the topside in plan view in FIG. 9.

Referring now to FIGS. 9 and 10, there is a third embodiment, wherein similar parts are designated by similar numerals with the addition of the suffix "b", wherein a tray 12b carries an edgewise stack of documents 26b that is transported by a plurality of moving belts 16b–20b and pushed by a plate-like member 30b toward the biased pivoted plate 28b.

The major modification in this embodiment is the incorporation of a belt means 210 that contacts the lead document 22b and moves it laterally through the nip with backup roller 68b to movement along backup plate 215 and further feed by belt 210 into the nip of acceleration rollers 130b and 132b. The presence or absence of a document is acknowledged by the sensors 136b and 138b in the fashion of the earlier embodiments set forth above resulting in forward or backward rotation, of the backup roller 68b in the same fashion set forth above for rollers 68 and 68a.

Other configurations will be apparent to those skilled in the art but is my intent to be only limited by the claims set forth below.

I claim:

1. A document feed and separation system including means for removing documents one at a time from a stack of documents and directing each document to a document separation station, said document separation station including document advancing means defining a nip adapted to receive and advance a single document directed from said stack of documents, to reverse movement of all but one of a plurality of documents received simultaneously in said nip from said stack of documents, and to stop movement of documents received from said stack of documents but not received in said nip, said document advancing means including a pair of nip rollers biased into tangential engagement with each other to define said nip, said nip rollers being adapted to grip and advance documents one at a time through said nip, one of said nip rollers being fixed to a first shaft driven by power means, the other of said nip rollers being mounted on a second shaft driven by said power means in the same direction of rotation as said first shaft and said one nip roller, said other nip roller being mounted on said second shaft for rotation relative to said second shaft, and friction engaging clutch means operatively connected between said second shaft and said other nip roller to permit said other nip roller to rotate in an opposite rotational direction to said one nip roller by a single document passing through said nip, and to halt the rotation of said other nip roller when two or more documents are attempting to pass through said nip simultaneously but have not entered said nip, said halted roller being operative to prevent more than one document at a time from passing through said nip.

2. The document feed and separation system to claim 1 wherein said friction engaging clutch means causes engagement between said second shaft and said other nip roller when two or more documents are received in and attempting to pass through said nip simultaneously so as to reverse the direction of rotation of said other nip roller and the direction of travel of all but one of said two or more documents whereby to prevent more than one document at a time from passing through said nip.

3. The document feed and separation system of claim 2 including sensing means associated with said document advancing means to produce a first signal when said other nip roller is caused to rotate in an opposite rotational direction to said one nip roller by a single document received in said nip, to produce a second signal when rotation of said other nip roller is halted by one or more documents engaging said other roller but not received in said nip, and to produce a third signal when the direction of rotation of said other nip roller changes from rotation in the same rotational direction as said one nip roller to rotation in an opposite direction to said one nip roller.

4. The document feed and separation system of claim 3 wherein said first, second and third signals are transmitted to controller means which selectively activate and deactivate said means for removing documents one at a time from said stack of documents.

5. The document feed and separation system of claim 1 wherein said friction engaging clutch means causes predetermined frictional engagement between said other roller and said second shaft such that the rotation of said other roller is halted by the counteraction of the friction force developed between two or more documents attempting to simultaneously enter said nip and said predetermined frictional engagement between said other nip roller and said second shaft.

6. The document feed and separation system of claim 1 wherein said friction engaging clutch means causes frictional engagement between said other nip roller and said second shaft such that said other nip roller is rotated in the same rotative direction as said second shaft by the counteraction of the friction forces developed between two or more documents received in and attempting to pass simultaneously through said nip and the friction force causing said friction engaging means to rotate said other nip roller with said second shaft.

7. The document feed and separation system of claim 1 wherein said friction engaging clutch means comprises a coil spring element extending around said second shaft and in sliding frictional contact with said second shaft, said coil spring element having one end protruding into a recess in said other nip roller radially spaced from the axis of said second shaft.

8. The document feed separation system of claim 7 wherein said sliding frictional contact between said coil spring element and said second shaft is calibrated such that the friction force developed between the coil spring element and the second shaft is approximately equal to the friction force developed between two documents attempting to simultaneously enter said nip, whereby said sliding frictional contact causes the rotation of said other roller to halt.

9. The document feed and separation system of claim 8 wherein said sliding frictional contact between said coil spring element and said second shaft is further calibrated such that the friction force developed between said coil spring element and said second shaft is less than the friction force developed between said other roller and a single document passing between said nip, whereby said other roller freely rotates with said coiled spring element around said second shaft.

10. The document feed and separation system of claim 9 wherein said sliding frictional contact between said coil spring element and said second shaft is further calibrated such that the sliding friction force developed between said coil spring element and said second shaft is greater that the friction force developed between more than two documents attempting to simultaneously pass between said nip so that said sliding frictional contact between said coil spring element and said second shaft causes said other roller to rotate in the same direction as said second shaft.

11. The document feed and separation system of claim 1 including sensing means associated with said other roller to produce a signal responsive to the rotative condition of said other roller, and means to transmit said signal to controller means which selectively activate and deactivate said means for preferably removing documents one at a time from said stack of documents.

12. The document feed and separation system of claim 11 wherein said sensing means includes encoded disc means circumferentially disposed on said other roller, and a sensor disposed adjacent said encoded disc means to produce said signal responsive to the rotative condition of said other roller.

13. The document feed and separation system of claim 12 wherein said other roller and said encoded disc means associated therewith produce a first signal in said sensor when said other roller is rotated in a first direction under the influence of a single document passing through said nip, said other roller and said encoded disc means being operative to produce a second signal in said sensor when rotation of said other roller is halted under the influence of two or more documents attempting to enter said nip simultaneously, and said other roller and said encoded disc means being operative to produce a third signal in said sensor when the direction of rotation of said other roller is reversed relative to said first direction.

14. A method of advancing documents one at a time through a document separation system which includes a pair of nip rollers between which said documents advance, said nip rollers, being biased toward each other for tangential contact and at least one of said nip rollers being rotated by power means, wherein said documents are fed one at a time from a stack of documents but may be improperly fed two or more at a time from said stack to said document separation system, the other of said nip rollers being mounted for free rotation about a rotating shaft and having friction engaging means operative to create a friction engagement between said other roller and said rotating shaft, the method comprising the steps of:

a) permitting said other roller to undergo free rotation in a first direction relative to said rotating shaft during passage of a single document between said nip rollers; and b) causing said other roller to halt rotation under the condition of two or more documents attempting to enter between said nip rollers so that all but one document are prevented from advancing between said nip rollers while said one document is allowed to advance between said nip rollers.

15. The method of claim 14 including the additional step of:

c) causing said other roller to rotate in a direction opposite to said first direction when two or more documents are simultaneously disposed between said nip rollers and attempting to advance between said nip rollers, whereby the direction of movement of all but one of said documents is reversed.

16. A document feed and separation system comprising, in combination, a document removal assembly for sequentially removing documents from a stack of documents and feeding each document to a document separation station, said document removal assembly including document contact means for engaging the lead document in the stack and advancing the lead document to the document separation station, said separation station including document advancing means having feed roller means defining a nip operative to receive documents advanced by said document contact means, said document advancing means including means operative to effect a document advance condition to advance a single document received in said nip from said document contact means, effect a document reverse condition to reverse movement of all but one of a plurality of documents received simultaneously in said nip from said document contact means until a single document remains in said nip, and effect a document stop condition to stop movement of documents which are received from said document contact means and engage said feed roller means without being received in said nip, and sensing means operatively associated with said feed roller means for sensing said document advance, document reverse and document stop conditions of said feed roller means.

17. The document feed and separation system of claim 16 wherein said document removal assembly includes face plate means disposed for abutment by the lead document in said stack, said face plate means including slot means formed therethrough, at least one selectively rotatably driven roller adapted for movement between a first position extending into said slot means to contact the lead document in said stack, and a second position removed from said slot out of contact with said lead document.

18. A document feed and separation system as defined in claim 16 wherein said feed roller means includes at least one pair of nip rollers biased into tangential engagement with each other to define said nip, one of said nip rollers being fixed to a first shaft, power means operatively associated with said first shaft for effecting selective rotation of said first shaft about its longitudinal axis, the other of said nip rollers being mounted on a second shaft adapted to be rotatably driven by said power means in the same rotational direction as said first shaft, friction engaging means operatively interconnecting said second shaft and said other nip roller to enable said other nip roller to rotate in an opposite rotational direction as said one roller in response to a single document received in said nip, said friction engaging means being operative to effect rotation of said other nip roller in the same rotational direction as said one nip roller when two documents are received in said nip simultaneously so as to prevent said two documents from passing through said nip simultaneously.

19. A document feed and separation system as defined in claim 18 wherein said friction engaging means is operative to effect rotation of said other nip roller in the same rotational direction as said one roller when two or more documents are received in said nip simultaneously so as to reverse the direction of movement of all but one of said two or more documents such that said documents pass through said nip one at a time.

20. A document feed and separation system as defined in claim 19 wherein said friction engaging means includes a unidirectional clutch having a coil spring element coiled about said second shaft and having an end fixed to said other nip roller.

21. A document feed and separation system as defined in claim 20 wherein said coil spring element engages said second shaft in sliding frictional contact therewith such that a friction force is developed between the coil spring element and the second shaft sufficient to prevent rotation of said other nip roller relative to said second shaft when two documents are received simultaneously in said nip.

22. A document feed and separation system as defined in claim 21 wherein said sliding frictional contact between said coil spring element and said second shaft is selected such that said other nip roller is caused to rotate in an opposite rotational direction to said one roller when a single document is received in said nip.

23. A document feed and separation system as defined in claim 22 wherein said sliding frictional contact between said coil spring element and said second shaft is selected such that a sliding friction force is developed between said coil spring element and said second shaft sufficient to effect rotation of said other nip roller with said second shaft when two or more documents are received in said nip simultaneously such that said other nip roller effects reverse movement of all but one of said documents within said nip.

24. A document feed and separation system as defined in claim 19 wherein said sensing means is operative to produce a first signal when a single document is received within said nip from said document advancing means, said sensing means being operative to produce a second signal when two or more documents are received at said nip and rotation of said other nip roller is stopped, said sensing means being operative to produce a third signal when said other nip roller is caused to rotate in the same rotational direction as said one nip roller when more than two documents are received within said nip from said document removal assembly.

25. A document feed and separation system as defined in claim 19 wherein said sensing means includes encoded disc means disposed circumferentially on said other nip roller, and a sensor disposed adjacent said encoded disc means and operative to produce said first, second and third signals responsive to the rotational condition of said other nip roller.

26. A document feed and separation system as defined in claim 25 wherein said other nip roller and said encoded disc are operative to produce a first signal in said sensor when said other nip roller is rotated in a first direction responsive to a single document received within said nip, said encoded disc and said sensor being cooperative to produce a second single when said other nip roller is stopped by documents engaging said other nip roller but not received within said nip, said encoded disc and sensor being operative to produce a third signal when a plurality of documents have entered said nip simultaneously and said other nip roller has reversed movement of all but one of said plurality of documents.

27. A document feed and separation system as defined in claim 16 wherein said feed roller means includes a drive roller and a backup roller defining a nip therebetween to receive documents advanced by said document removal assembly, said document separation station including means for effecting rotation of said drive roller in a direction to advance a single document received in said nip, said sensing means being operative to stop rotation of said drive roller when more than two documents are received simultaneously in said nip, and being operative to reverse rotation of said backup roller when more than two documents enter said nip simultaneously.

* * * * *